United States Patent [19]

Karr et al.

[11] Patent Number: 4,782,531

[45] Date of Patent: Nov. 1, 1988

[54] MULTICHANNEL FM SUBCARRIER BROADCAST SYSTEM

[76] Inventors: Lawrence J. Karr, 445 15th St., Santa Monica, Calif. 90402; Steven J. Davis, 616 8th St., Manhattan Beach, Calif. 90266; Andrew Barber, 4109 Via Marina, Apt. R120, Marina Del Rey, Calif. 90291

[21] Appl. No.: 65,911

[22] Filed: Jun. 23, 1987

[51] Int. Cl.[4] ..... H04H 5/00

[52] U.S. Cl. ..... 381/14; 332/23 A

[58] Field of Search ..... 332/23 A; 455/45; 381/2, 3, 4, 14, 15, 16; 375/39

[56] References Cited

U.S. PATENT DOCUMENTS

| | | | |
|---|---|---|---|
| 3,268,663 | 8/1966 | Cramer | 381/4 |
| 3,518,376 | 6/1987 | Kamen . | |
| 4,472,831 | 9/1984 | Yokoya | 381/16 |
| 4,589,127 | 5/1986 | Loughlin | 381/16 |

*Primary Examiner*—Forester W. Isen

*Attorney, Agent, or Firm*—Ronald W. Reagin; Stephen L. King

[57] ABSTRACT

A multichannel FM subcarrier broadcast system is disclosed which enables the transmission of multiple independent signals by generating independent sidebands of suppressed carriers in the subcarrier band of an FM transmitting station. Transmitting and receiving apparatus is disclosed which employs phase shift networks to minimize interchannel distortion, thus allowing close spacing of adjacent sidebands.

2 Claims, 3 Drawing Sheets

SHOWS 3 PAIRS OF INDEPENDENT SIDEBANDS AND 1 LOWER ONLY – TOTAL OF 7 BANDS

MULTICHANNEL FM SUBCARRIER BROADCAST SYSTEM

BACKGROUND OF THE INVENTION

This invention relates to radio frequency communication systems and more particularly to systems for transmitting and receiving multi-channel information over pairs of independent sidebands using multiple FM subcarriers, with a minimum of interchannel distortion.

The prior art has seen many systems for transmitting radio signals by means of subcarriers. In general, the number of signals which may be transmitted is a function of the accuracy with which frequency selection may be accomplished for the subcarriers and the sidebands. In general it is quite difficult to arrange subcarrier sidebands adjacent one another without leaving a substantial frequency range to eliminate overlap between sideband signals.

For example, U.S. Pat. No. 3,518,376 to Cayman and Walker discloses a system in which a plurality of single sideband audio modulated subcarrier signals are superimposed on an FM broadcast signal. As that patent demonstrates, heretofore the individual subcarrier signals are FM single sideband and are widely spaced in order to eliminate interference between channels. For this reason the number of information channels in a given bandwidth is drastically reduced.

It is an object of the present invention to provide a radio frequency communication system employing closely spaced dual independent sideband AM modulation of multiple FM subcarriers with a minimum of interchannel distortion.

It is another object of this invention to provide new transmitter and receiver designs to enable the use of dual independent sideband AM modulation of multiple FM subcarriers.

SUMMARY OF THE INVENTION

These and other objects of this invention are accomplished by a transmission system in which phase shift networks are employed in order to generate sidebands in channel pairs, those sideband pairs being phase shifted from one another prior to transmission. Upon receipt at a receiver, the signals are reconstituted and again phase shifted to provide resulting signals which may be very closely spaced without requiring substantial interchannel bandwidth to compensate for distortion in transmission. The details of this invention will be better understood by reference to the detailed specification and the drawings.

DESCRIPTION OF THE PREFERRED EMBODIMENTS

Figure 1:
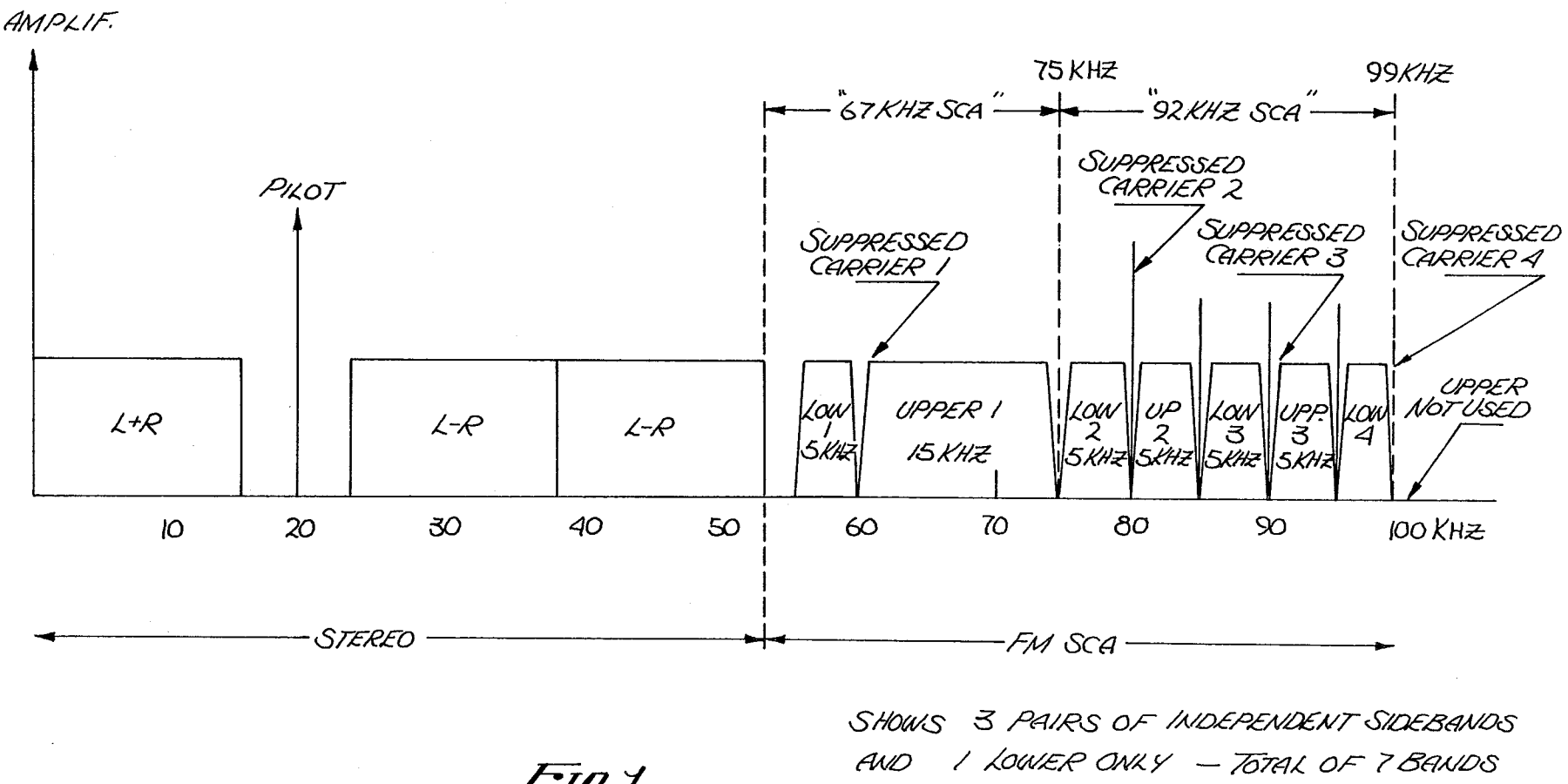
FIG. 1 is a graph illustrating the various signals carried by a particular transmission system constructed in accordance with the invention.

Referring now to FIG. 1, there is shown a graph illustrating the spectrum of signals generated by an FM transmitting station when operating using the transmitter circuits of the present invention.

The first 53 kilohertz of the station bandwidth, labled "stereo" in FIG. 1, is occupied with the standard FM monaural and FM stereo signals. In the past, the band between 53 kilohertz and the allocated bandwidth limit of 100 kilohertz, known as the subcarrier band, was generally unused or used for broadcasting one or two single sideband FM signals.

It is an object of the present invention to provide transmitter signal processing circuity to enable the transmission of a multitude of independent signals in the subcarrier band. This is accomplished by enabling the transmission of multiple supressed carriers, each having closely spaced single or dual AM modulated sidebands, each carrying an independent signal.

Referring again to FIG. 1, there are shown several examples of the subcarrier band transmission spectra which may be generated by the present invention.

The subcarrier band includes four suppressed carriers placed at 60 khz, 80 khz, 90 khz and 99 khz. Suppressed carrier 1 supports lower and upper independent sidebands having bandwidths of 5 khz, and 15 khz, respectively. The narrower bandwidth may be used for voice only communication, while the wider bandwidth is useful for music and data.

Suppressed carriers 2 and 3 each support upper and lower independent sidebands having bandwidths of 5 khz. Suppressed carrier 4 supports a single lower sideband with a bandwidth of 5 khz. Note from FIG. 1 that adjacent sidebands are in essence contiguous at their extremes, allowing for extremely efficient use of the subcarrier band. As described below, the novel circuits of the present invention enable the close spacing of sidebands, where each sideband is independent and can have a bandwidth tailored to the application.

Figure 2:
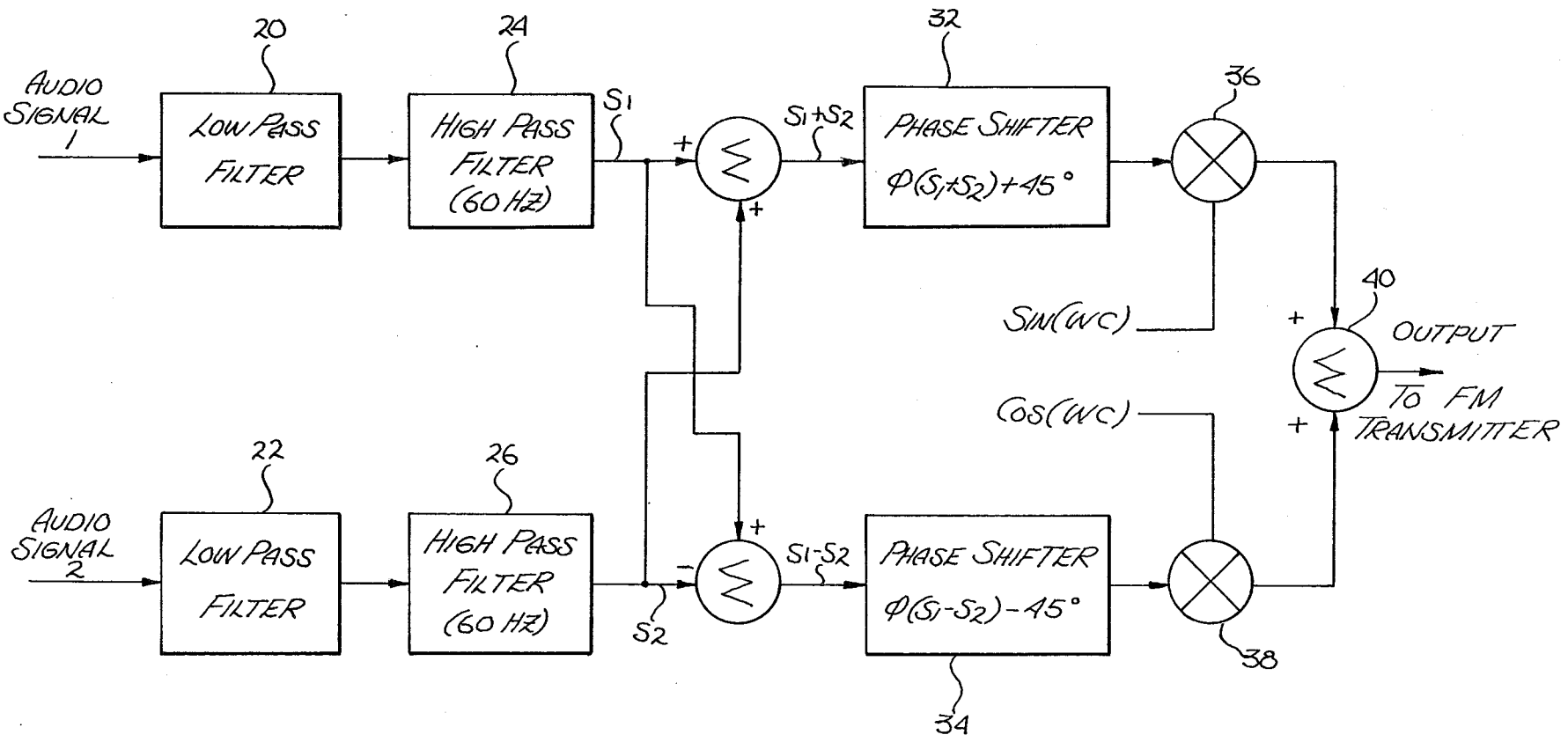
FIG. 2 is a block diagram of transmitter circuits constructed in accordance with the invention.

Referring now to FIG. 2, there is shown a block diagram of signal conditioning apparatus used to provide a suppressed carrier signal having two independent AM modulated sidebands for transmitting signals representing two independent audio signals (referred to as audio signal 1 and audio signal 2) in the subcarrier band of an FM transmitting station. Audio signals 1 and 2 are each provided to low pass filters 20 and 22, respectively. The purpose of these filters is to set the sideband bandwidth for that particular signal. For example, 5 khz might be used for voice only and 15 khz for music.

The signals from the filters 20 and 22 are provided as input signals to high pass filters 24 and 26 respectively. The purpose of these filters is to remove 60 khz components from the signals. The signal exiting the filter 24 (labeled $S_1$) is provided to a positive input terminal of summer 28, while the signal exiting the filter 26 (labeled $S_2$) is provided to a negative input terminal of summer 30. The signal $S_1$ is also provided to a positive input terminal of summer 30, and the signal $S_2$ is provided to a positive input terminal of summer 28.

The signal exiting the summer 28 is the signal sum $S_1+S_2$, and is provided to a phase shift network 32 which shifts the phase of its input signal by $+45°$. Similarly, the signal exiting the summer 30 is the signal difference $S_1-S_2$, and is provided to a phase shift network 34 which shifts the phase of its input signal by $-45°$.

The phase shifted signal exiting the shifter 32 is provided to mixer 36 along with a signal representing the sine of the supressed carrier which is to support the independent sidebands carrying the audio signals. Similarly, the phase shifted signal exiting the shifter 34 is provided to mixer 38 along with a signal representing the cosine of the suppressed carrier.

The output signals from the mixers 36 and 38 are summed together by summer 40. The output signal from the summer 40 is provided to the modulator of a commercial FM transmitter along with the standard FM stereo signals.

Assuming the bandwidths of the filters 20 and 22 were both set to 5 khz and the carrier frequency was set to 80 khz, the sidebands labeled lower 2 and upper 2 in FIG. 1 would be produced by the signal conditioning apparatus of FIG. 2, as described above.

While the phase shifters 32 and 34 have been described in terms of +45° and −45° phase shifts, the embodiment is by no means limited to these values. The criterion for the phase shifters 32 and 34 is that, in combination, they provide a 90° phase shift between the signals $(S_1+S_2)$ and $(S_1-S_2)$ over the frequency range of interest for these signals. For example, shifter 32 might be configured to provide a +15° phase shift to signal $(S_1+S_2)$, and the shifter 33 might be configured to provide a +105° phase shift to signal $(S_1-S_2)$.

In the extreme, it is conceivable that one of the phase shifters could be eliminated, while the other phase shifter provides a 90° shift to only one of the signals. The phase shifters 32 and 34 shown in FIG. 2 are chosen at +45° and −45° for design and manufacturing convenience. In actual practice, the characteristics of the networks 32 and 34 are such that the incoming signals are shifted in phase by a value which changes logarithmically as a function of incoming signal frequency in a manner well known to those skilled in the art.

Figure 3:
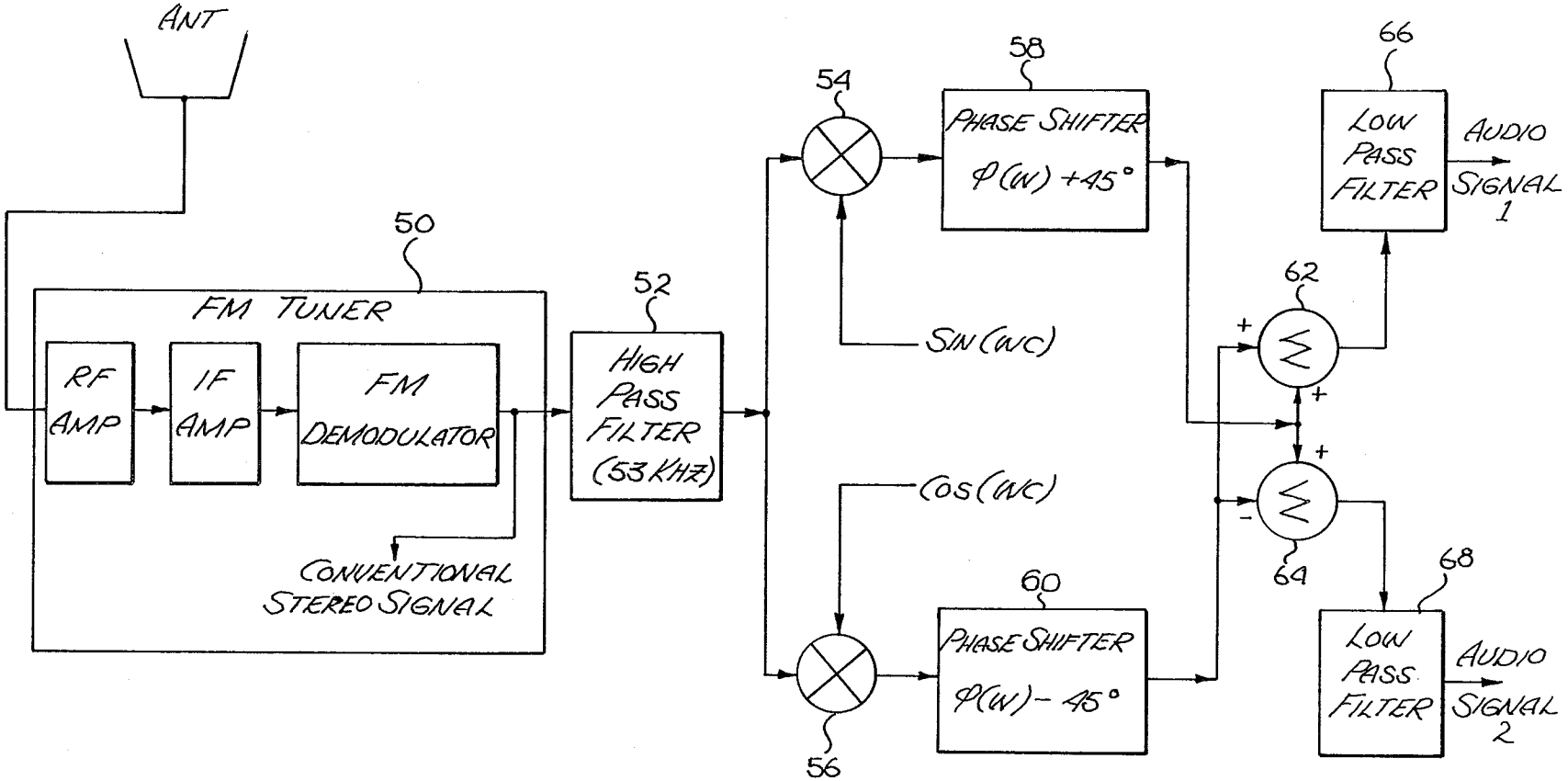
FIG. 3 is a block diagram of receiver circuits constructed in accordance with the invention.

To receive the signals broadcast using the apparatus of FIG. 2, the receiving apparatus shown in FIG. 3 is used in conjunction with the circuits employed in a conventional FM stereo tuner.

Referring to FIG. 3, the front end circuits of a conventional FM stereo tuner 50 (RF and IF amplifiers and FM demodulator) are employed to provide a demodulated signal which contains the conventional FM stereo broadcast in the zero to 53 khz band, and contains the subcarrier sideband signals in the 53 to 100 khz band.

The demodulated signal from the tuner 50 is provided to a high pass filter 52 which removes the lower FM stereo band from the signal. The filtered signal is applied to mixers 54 and 56 where it is mixed with the sine and cosine respectfully, of the suppressed carrier frequency.

The output signal from mixer 54 is provided to phase shifter 58 where the phase of the incoming signal is shifted by +45°. The output signal from mixer 56 is provided to phase shifter 60 where the phase of the incoming signal is shifted by −45°.

As in the instance of the transmitting phase shift networks 32, 34 described above, the criterion for the phase shifters 58 and 60 is that, in combination they provide a 90° phase shift between the signals exiting the mixers 54 and 56. Hence, the actual phase shift values for the shifters 58 and 60 need not be +45° and −45°, nor need they be the same values as attributed to the networks 32 and 34.

The output signal from phase shifter 58 is provided to positive input terminals of summers 62 and 64. The output signal from phase shifter 60 is provided to a positive input terminal of summer 62 and to a negative input terminal of summer 64.

The output signal from summer 62 is passed through a low pass filter 66 where the carrier frequency is removed, and the resultant signal is the audio signal 1. Similarly, the output signal from summer 64 is passed through low pass filter 68, where the carrier frequency is removed, and the resultant signal is the audio signal 2.

As shown in FIG. 1, the particular carrier frequencies and sideband bandwidths may be chosen to provide a broadcast system in which a large number of signals may be transmitted and received using multiple independent sidebands in the FM subcarrier band.

One of the features of the above-described broadcast system is that it does not require phase locking circuits to operate. Thus, the system is less sensitive to channel distortion than previous systems.

Another feature of the present invention is that the AM suppressed carrier independent sideband transmitter mechanization does not produce a constant amplitude signal. Accordingly, when the sideband signal is mixed in the transmitter modulator with the conventional stereo signal, there is little interference with that stereo signal.

While a preferred embodiment of the invention has been shown and described, it is to be understood that various other adaptations and modifications may be made within the spirit and scope of the invention. It is thus intended that the invention be limited in scope only by the appended claims.

What is claimed is:

1. A multichannel FM subcarrier transmission system for providing a transmitter modulation signal for broadcasting first and second information signals as independent sidebands of a suppressed carrier in the subcarrier band of an FM transmitting station, comprising:

filter means for limiting the bandwidth of the first and second information signals to predetermined values to provide first and second filtered signals;

summing means for providing a sum signal which is the sum of the first and second filtered signals;

difference means for providing a difference signal which is the difference between the first and second filtered signals;

phase shift means for shifting the phase of the sum signal by a first amount to provide a first phased signal, and for shifting the phase of the difference signal by a second amount to provide a second phased signal, where the first and second amounts are chosen to provide a 90° phase difference between the sum and difference signals;

first mixing means for mixing the first phased signal with the sine of the suppressed carrier to provide a first mixed signal;

second mixing means for mixing the second phased signal with the cosine of the supressed carrier to provide a second mixed signal;

second summing means for summing the first and second mixed signals to provide the transmitter modulation signal;

and means for applying the transmitter modulation signal to frequency modulate a carrier wave.

2. A multichannel FM subcarrier receiver system for recovering from the FM demodulated signal of an FM tuner first and second information signals broadcast as independent sidebands of a suppressed carrier in the subcarrier band of an FM transmitting station, comprising:

filter means for limiting the bandwidth of the FM demodulated signal to the subcarrier band of the FM transmitting station, providing a filtered signal;

first and second mixing means for mixing the filered signal with respectively, the sine and cosine of the suppresssed carrier to thus provide first and second mixed signals;

phase shifting means for shifting the phase of the first mixed signal by a first amount to provide a first phased signal, and, for shifting the phase of the second mixed signal by a second amount to provide a second phased signal, where the first and second amounts are chosen to provide a 90° phase difference between the first and second phased signals;

summing means for providing, respectively, the sum of and the difference between the first phased and the second phased signals to provide, respectively, sum and difference signals;

second filter means for removing the suppressed carrier from the sum and difference signals to provide respectively, the first and second information signals.

* * * * *